US007323811B2

(12) United States Patent
Tinwell et al.

(10) Patent No.: US 7,323,811 B2
(45) Date of Patent: Jan. 29, 2008

(54) NOBLE METAL TIP FOR SPARK PLUG ELECTRODE AND METHOD OF MAKING SAME

(75) Inventors: Paul Tinwell, Northwich (GB); Gurdev Orjela, Autelbas Barnich (BE)

(73) Assignee: Federal-Mogul Ignition (U.K.) Limited, Manchester (GB)

( * ) Notice: Subject to any disclaimer, the term of this patent is extended or adjusted under 35 U.S.C. 154(b) by 211 days.

(21) Appl. No.: 10/787,280

(22) Filed: Feb. 26, 2004

(65) Prior Publication Data

US 2005/0052106 A1 Mar. 10, 2005

Related U.S. Application Data

(63) Continuation-in-part of application No. 10/486,962, filed as application No. PCT/EP02/09275 on Aug. 15, 2002.

(30) Foreign Application Priority Data

Aug. 23, 2001 (EP) ..... 01000403

(51) Int. Cl.
*H01T 1/22* (2006.01)
*H01T 13/20* (2006.01)

(52) U.S. Cl. ..... 313/141; 313/143; 313/144; 123/169 EL

(58) Field of Classification Search ..... 313/141–143
See application file for complete search history.

(56) References Cited

U.S. PATENT DOCUMENTS 2,296,033 A 9/1942 Walter
5,320,569 A 6/1994 Oshima et al.
5,347,193 A 9/1994 Oshima et al.
5,811,915 A 9/1998 Abe et al.
5,982,080 A * 11/1999 Shibata et al. ..... 313/141
6,093,071 A 7/2000 Osamura et al.
6,094,000 A 7/2000 Osamura et al.
6,147,441 A 11/2000 Osamura
6,215,235 B1 * 4/2001 Osamura ..... 313/141
6,262,522 B1 7/2001 Osamura et al.
2004/0239224 A1 * 12/2004 Orjela et al. ..... 313/142

FOREIGN PATENT DOCUMENTS

DE 2224270 11/1973
DE 4238973 5/1994
DE 10225800 12/2003

(Continued)

*Primary Examiner*—Mariceli Santiago
(74) *Attorney, Agent, or Firm*—Reising, Ethington, Barnes, Kisselle, P.C.

(57) ABSTRACT

A noble metal tip 20 for attachment to a spark plug center electrode 36 and/or a ground electrode. Noble metal tip 20 is a generally cylindrical component that includes a firing end 40, an attachment end 42, and one or more retention features 44, 46 and 60, 62. The retention features are generally conically shaped holes or recesses formed in the side of the noble metal tip, and are designed to receive molten material during a laser attachment process. Once the molten material has solidified in the retention features, a fusion layer is formed and acts as a mechanical bond or interlock between the noble metal tip and the electrode. Methods of manufacturing and attaching the noble metal tips are also provided.

34 Claims, 4 Drawing Sheets

FOREIGN PATENT DOCUMENTS

| | | | | |
|---|---|---|---|---|
| DE | 10327595 | | | 2/2004 |
| EP | 0834973 | | | 4/1998 |
| EP | 1139530 | A2 | * | 10/2001 |
| JP | 02-061973 | | | 3/1990 |
| JP | 09106879 | A | * | 4/1997 |
| WO | WO 2006008659 | A2 | * | 1/2006 |

* cited by examiner

NOBLE METAL TIP FOR SPARK PLUG ELECTRODE AND METHOD OF MAKING SAME

CROSS-REFERENCE TO RELATED APPLICATIONS

This application is a continuation-in-part of prior U.S. application Ser. No. 10/486,962, which is the National Stage of International Application No. PCT/EP02/09275 filed Aug. 15, 2002.

FIELD OF THE INVENTION

This invention generally relates to spark plugs used in internal combustion engines. More specifically, this invention relates to the configuration of a noble metal tip attached to a center and/or a ground electrode, and a method of making the same.

BACKGROUND OF THE INVENTION

It is known in the art to prolong the life of spark plug electrodes by attaching precious or noble metal tips to their firing ends. Some of the earliest examples of this technology are seen in U.S. Pat. No. 2,296,033 issued Sep. 15, 1942 to Heller, and in British Patent Specification No. 479,540 published in 1938 to Powell et al. The Heller patent teaches the attachment of precious metal tips to ground and center electrodes formed of much less expensive materials. The precious metal tips are comprised of corrosion resistant materials, including platinum alloys such as platinum-rhodium, platinum-iridium and platinum-ruthenium. Similarly, the Powell reference discloses the use of platinum, iridium, ruthenium, osmium and alloys thereof, including iridium-rhodium, for use as firing tips for spark plug electrodes. In the time since this and other early designs, there have sprung numerous other inventions attempting to utilize the corrosion and erosion resistant properties of noble and other precious metals.

For many years, platinum was the precious metal of choice for spark plug electrode firing tips, as evidenced by the numerous patents describing its use. During recent years, however, numerous other noble metals and noble metal alloys have become more frequently utilized; one of which is iridium. Iridium can be relatively inexpensive, when compared to other noble metals, and has the rather high melting point of approximately 2410° C. Though many benefits exist regarding the use of iridium, it is sometimes a challenge to work the noble metal, as it has a tendency to crack under mechanical pressure and deformation. In order to overcome this and other challenges, various iridium-alloys have been developed with the hope of imparting certain, desirable characteristics to the metal. An example of such an alloy is taught in U.S. Pat. No. 6,094,000 issued Jul. 25, 2000 to Osamura et al. In this reference there is disclosed an Ir—Rh alloy whose relative percentages of iridium and rhodium vary according to one of several embodiments.

Attachment of iridium and other such firing tips is commonly done by welding and, in particular, laser welding of the tip to a center electrode. Typically, the tip is in the form of a segment of cylindrical wire. However, other tip configurations also exist for use with other attachment techniques. See, for example, U.S. Pat. No. 6,614,145 to Fleetwood et al. in which an iridium tip with an enlarged head is attached by swaging and brazing the tip within a blind hole of an upper electrode.

SUMMARY OF THE INVENTION

The present invention is directed to a noble metal tip which, according to one embodiment, is for use with a spark plug electrode, and includes a firing end having a sparking surface, an attachment end, and a retention feature that extends generally radially inwardly into the noble metal tip. The noble metal tip is capable of being inserted into a bore located in either a spark plug center and/or ground electrode such that the sparking surface is located outside of the bore and the retention feature is located within the bore.

According to another embodiment, there is provided a center electrode assembly for use in a spark plug that includes a center electrode, a noble metal tip, and a fusion layer. The center electrode includes a front end having a blind bore, and the noble metal tip includes a firing end having a sparking surface, an attachment end located within the blind bore, and a retention feature. The retention feature receives at least a portion of the fusion layer such that the noble metal tip is secured within the blind bore.

According to another embodiment, there is provided a method of manufacturing a spark plug electrode assembly. The method includes the steps of: (a) providing a noble metal wire, (b) providing either a center or ground electrode, (c) drilling retention features into the noble metal wire, (d) inserting an end of the noble metal wire into a recess in the electrode, (e) applying a laser to the electrode such that a molten material flows into the retention features, and (f) cutting the noble metal wire to a predetermined length.

BRIEF DESCRIPTION OF THE DRAWINGS

These and other objects, features and advantages of this invention will be apparent from the following detailed description of the preferred embodiments and best mode, the appended claims and the accompanying drawings, in which:

DETAILED DESCRIPTION OF THE PREFERRED EMBODIMENT

Figure 1:
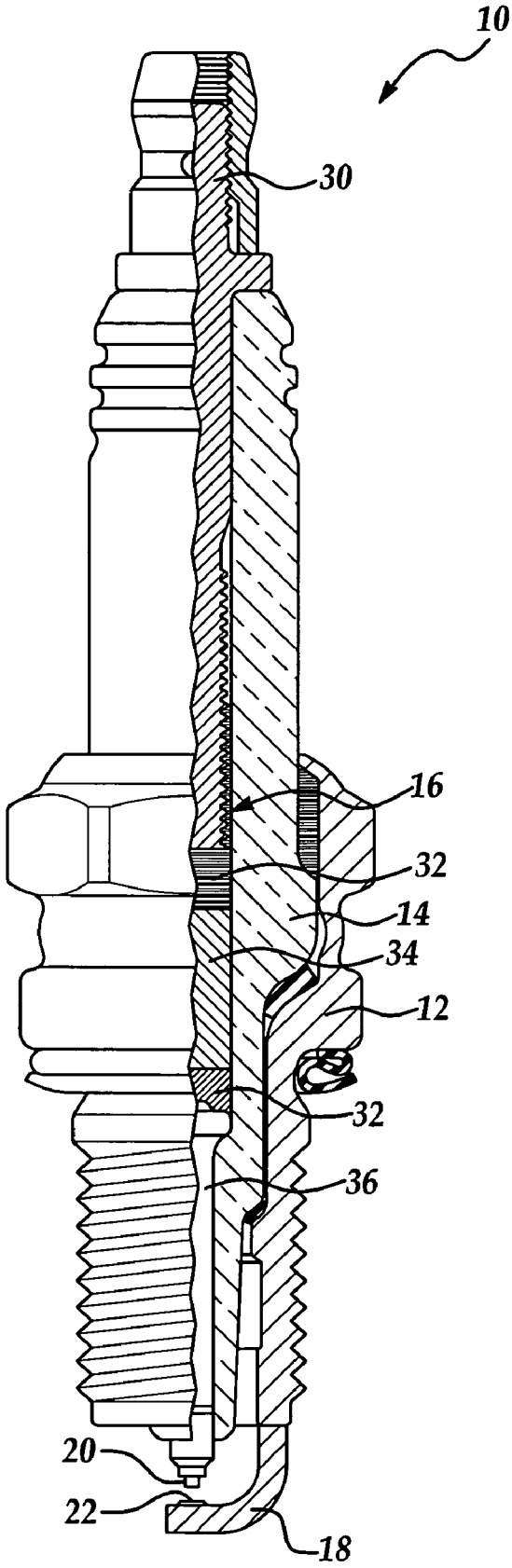
FIG. 1 shows a partial fragmentary view of a spark plug having a noble metal tip attached to a firing end of a center electrode.

With reference to FIG. 1, there is shown a spark plug assembly 10 for use in an internal combustion engine (not shown) that generally includes a shell 12, an insulator 14, a center wire assembly 16, a ground electrode 18, a noble metal tip 20 and a noble metal pad 22. As commonly known in the art, the shell 12 is a generally cylindrical, electrically conductive component having a hollow bore extending along its axial length. Within that bore are a series of circumferential shoulders sized to support diametrically reduced sections of the insulator. Like the shell, the insulator 14 is also a generally cylindrical component with an elongated axial bore, and is made from generally non-conducting materials. The lower axial end of the insulator comprises a nose portion which extends out of and beyond the lowermost portion of the shell. The insulator axial bore is designed to receive the electrically conductive center wire assembly 16, which extends the entire axial length of the spark plug and generally includes a terminal electrode 30, one or more conductive and/or suppressive seals 32, a resistive component 34, and a center electrode assembly 36. The center wire assembly 16 shown here is simply one of numerous possible embodiments, and could include additional components or have components omitted. The ground electrode 18 is both mechanically and electrically connected to the lower axial end of the shell and is generally formed in an L-shape configuration. The exposed end of the center electrode assembly 36 and a side surface of the ground electrode 18 oppose each other and respectively carry a noble metal tip 20 and noble metal pad 22, thereby forming a spark gap. The noble metal tip and pad are each more erosion and oxidation resistant than conventional electrode materials, and thus increase the operational life of the plug.

Figure 2:
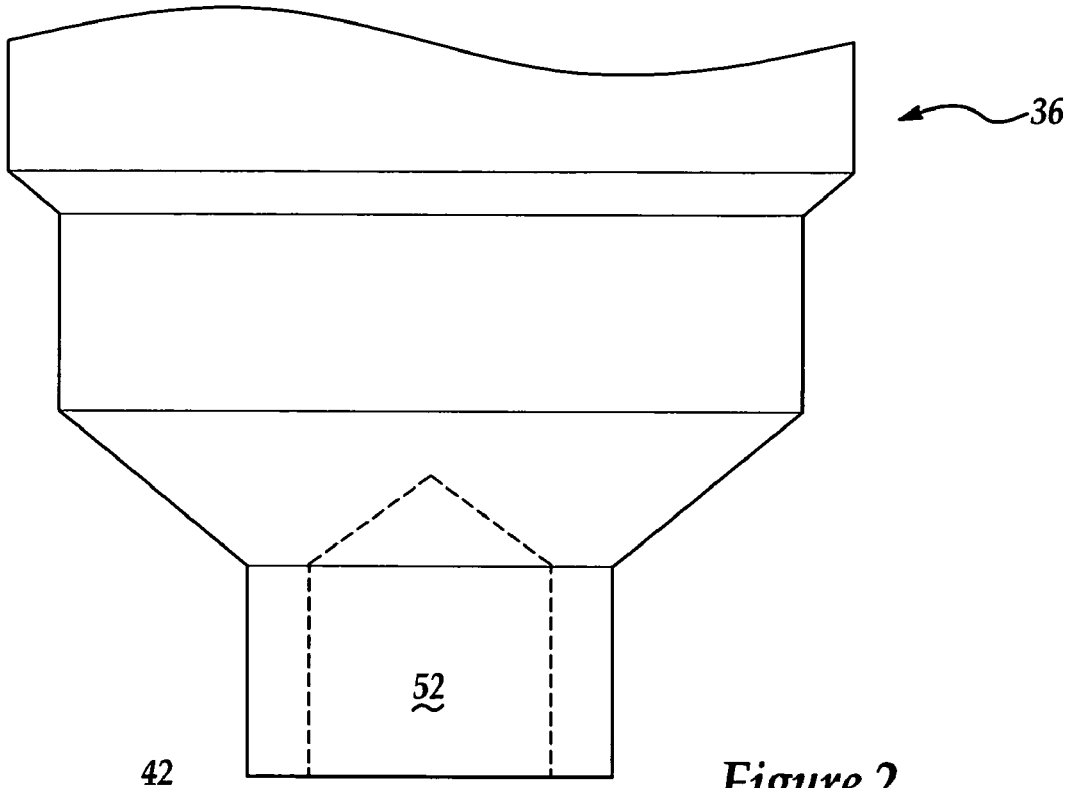
FIG. 2 shows an enlarged view of the noble metal tip and the center electrode firing end of FIG. 1.

FIG. 2 shows the noble metal tip 20 before it is attached to the center electrode assembly 36. The noble metal tip is preferably made from an iridium-based material; that is, either pure iridium or an alloy having iridium as the primary constituent. Examples of appropriate iridium-based alloys include iridium-rhodium, iridium-platinum, iridium-ruthenium and iridium-palladium, as well as other iridium-alloys known in the art. Platinum and other non-iridium based tips could also be used. Noble metal tip 20 is a generally cylindrical component that includes a firing end 40, an attachment end 42, and one or more retention features 44, 46 and 60, 62. The firing end 40 is the end of the noble metal tip 20 that protrudes from the center electrode assembly 36 to form a spark gap with ground electrode 18. The firing end 40 includes a sparking surface 50, from which a combustion-initiating spark arcs across the spark gap to the ground electrode. The sparking surface 50 shown here is flat, however, a concave, convex, pointed, or otherwise shaped sparking surface could also be used. Preferably, sparking surface 50 of the noble metal tip protrudes beyond the tapered end of the center electrode by a distance of 0.1 mm-1.0 mm and the sparking surface preferably has a diameter of between 0.25 mm-1.0 mm. The sparking surface could alternatively have a non-circular cross-sectional shape.

The attachment end 42 is a generally tapered end of the noble metal tip that is designed to be received within a tapered, blind axial bore 52 of the center electrode assembly 36. Blind axial bore 52 preferably includes a tapered portion that terminates in a point; a design that is easy to manufacture and provides a complementary hole for attachment end 42. Alternative axial bore designs could be used as well, including axial bores having multiple tapered potions thus producing a stepped bore, or no tapered portions at all. As will be explained in greater detail, the attachment end 42 is formed during the manufacturing/attachment process, and includes a tapered section 54 culminating in a point 56. Of course, the attachment end 42 could culminate in some alternative shape instead of the point, such as a flat end, a rounded tip, etc. As demonstrated in FIG. 2, the blind axial bore 52 of the center electrode assembly is designed to accommodate the tapered attachment end 42. The precise shape, size, etc. may vary according to the configuration of the noble metal tip 20 being used. It is preferable that the center electrode material be a nickel-based material exhibiting a high degree of resistance to erosion, corrosion, heat, etc. Examples of appropriate materials include, but are not limited to, #522 alloy, manufactured and sold by Champion Spark Plug Co. of Toledo, Ohio and Inconel™ 600.

Figure 3:
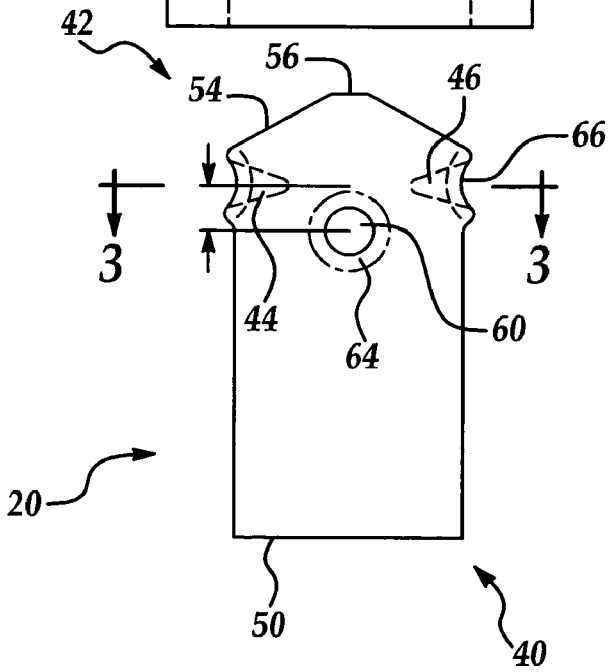
FIG. 3 shows a cross-sectional view of the noble metal tip of FIG. 2 taken along lines 3-3.
Figure 3:
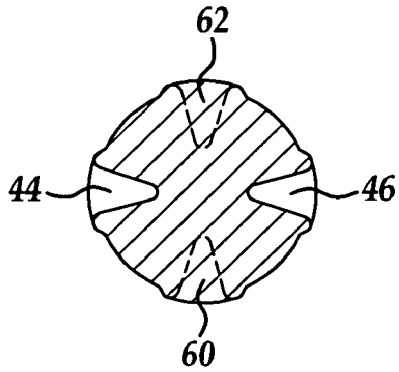

With reference to FIGS. 2 and 3, retention features 44, 46 and 60, 62 are shown from several perspectives. The retention features are designed to receive molten center electrode and/or noble metal material during the laser attachment process, thereby forming a fusion layer 102 (seen in FIG. 5) and improving the strength of the bond between the noble metal tip 20 and the center electrode assembly 36. Once the molten material has solidified in the retention features, the fusion layer acts as a mechanical bond or interlock. According to the particular embodiment shown in FIGS. 2 and 3, retention features 44, 46 and 60, 62 are generally conically shaped holes or recesses formed in the side of the noble metal tip. Preferably, each of these holes has an opening with a diameter that is between 0.05 mm-0.3 mm, an even more desirable diameter between 0.1 mm-0.2 mm, and a most desirable diameter between 0.1 mm-0.15 mm (these dimensions are particularly applicable to noble metal tips having a diameter of about 0.7 mm). The retention features shown here extend in a radial direction, but do not interconnect or otherwise pass entirely through the tip. Stated differently, retention features 44, 46 and 60, 62 extend into the tip by a distance that is less than the diameter of the noble metal tip. In a preferred embodiment, each of the retention features radially extends into the noble metal tip by a radial depth of between 0.05 mm-0.3 mm, in a more desirable embodiment they extend between 0.075 mm-0.2 mm, and in a most desired embodiment they extend between 0.1 mm-0.15 mm. Other embodiments are also possible, such as where the retention features extend the entire diameter of the noble metal tip such that they pass completely through the tip, or where two retention features radially extend towards each other and join within the noble metal tip. Noble metal tip 20 preferably has four retention features (feature 62 cannot be seen in FIG. 2). Retention features 44, 46 are located on the noble metal tip at a first axial position and are spaced around the circumference of the tip such that they are separated by approximately 180°. Similarly, retention features 60, 62 are located on the noble metal tip at a second axial position and are spaced around the tip circumference such that they also are separated by approximately 180°. The first and second axial positions of the retention features are such that all four holes are located within the blind bore when the noble metal tip is attached to the center electrode component, and the two axial positions are separated by an axial distance x, that is preferably between 0-1.0 mm. The retention features may be arranged according to one of numerous configurations; the configuration of FIGS. 2 and 3 simply being one of them. For example, instead of there being two retention features separated by 180° at a particular axial location, there could be three retention features separated 120°, or four retention features separated by 90°. Retention features other than conical holes, such as cylindrical holes, grooves, indentations, scores, roughened surfaces, etc. can be used as well to receive the molten center electrode and/or noble metal materials during the attachment process. According to one embodiment, the retention feature includes one or more grooves on the outer cylindrical surface of the tip that extends around the entire circumference of the tip.

Figure 4:
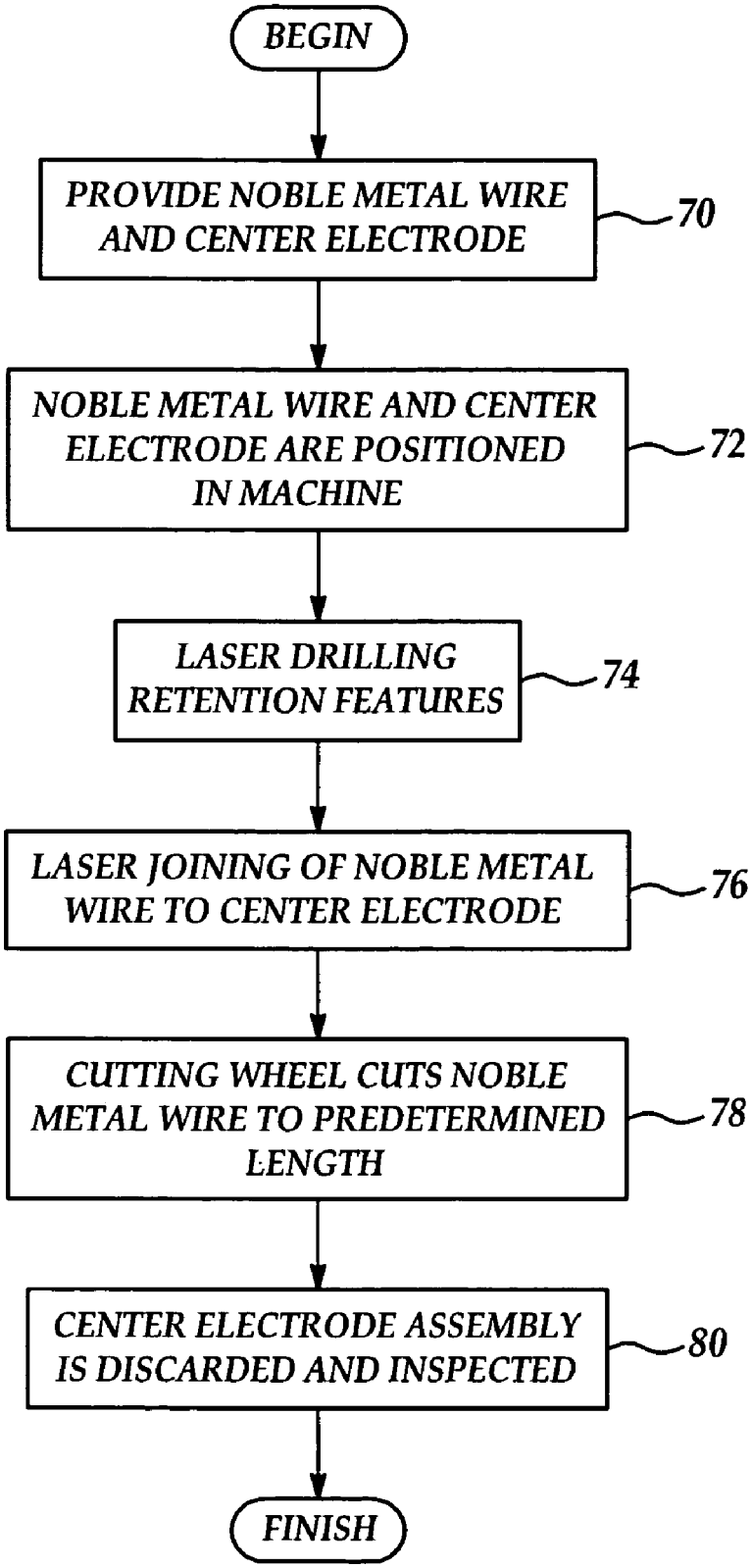
FIG. 4 is a flowchart showing a general overview of a process for manufacturing and attaching a noble metal tip to a center electrode.

Turning now to FIG. 4, the flowchart shows a general overview of the process for manufacturing and attaching a noble metal tip. Beginning with step 70, a stock of noble metal wire and a machined center electrode component are first provided; methods of manufacturing noble metal wire involve steps such as casting, forging, drawing, rolling, etc., and are already known in the art. As previously explained, while it is preferable that the noble metal wire be comprised of an Ir-based material, such as an Ir—Rh alloy, it could also be comprised of another noble metal or noble metal alloy. The noble metal wire is desirably provided in the form of straight rods having a predetermined length, such as 1.0 m, and a predetermined diameter, such as 0.7 mm. The center electrode components are already machined when they are provided in step 70 such that they include an axially centered blind bore. Next, step 72 involves feeding the noble metal wire and the center electrode component into a machine that positions the two components in coaxial alignment, such that the attachment end 42 of the noble metal tip faces the blind bore 52. Then, before insertion of the tip into the blind bore, the noble metal wire is advanced to a "laser drilling" position; that is, a position where one or more laser heads are able to radially drill the retention features into the noble metal wire. Then, at step 74, two laser heads are positioned facing the wire (spaced by approximately 90° from each other) such that each laser head is capable of emitting a laser beam in a direction generally perpendicular to the axis of the wire. The retention features are drilled in a generally radial direction, but do not extend the entire diameter of the noble metal wire. As will be known to those skilled in the art, this laser drilling process utilizes high intensity laser light to cause selective, localized evaporation of the noble metal wire material. The particular operating parameters of the laser, such as the energy/pulse, the duration of each pulse, the type of laser used, etc., can vary according to the size and shape of the desired retention features, the composition of the noble metal wire, as well as other factors known to those skilled in the art. Once the two laser heads have drilled two retention features, the noble metal wire may be angularly indexed such that the two laser heads may drill another pair of retention features. A potential result of the laser drilling process is the formation of a slightly protruding, circumferential lip surrounding each of the laser drilled retention features or holes. This can be seen in FIGS. 2 and 3, where each of the retention features 44, 46 and 60, 62 are circumscribed by a circumferential lip. As an example, lip 64 is shown surrounding hole 60 and lip 66 is shown surrounding hole 46. Alternative drilling or processing techniques, such as those that use a conventional drill bit, abrasive wheel, etc. can of course be used to form the retention features, instead of the laser drilling process described above. Once the retention features have been formed, the noble metal wire is advanced in an axial direction such that it is inserted into the blind bore of the center electrode component.

Step 76 involves joining the noble metal wire and the center electrode component together to form a center electrode assembly. It should be recognized that numerous welding and joining techniques exist for joining a noble metal tip to a spark plug electrode, and that any appropriate method could be used for securing the noble metal wire within the blind bore. According to one technique, a laser is used to laser weld the noble metal tip within the axial bore of the center electrode. Use of this technique involves the melting of both the center electrode and noble metal materials, such that they together flow into and solidify within the axial bore. Because this technique is widely documented and known within the art, a recitation of the details herein has been omitted. Accordingly to another technique, a pair of laser heads are preferably spaced from each other by about 180° and emit laser beams that melt a portion of the center electrode material surrounding the blind bore. This causes the molten material, which only consists of center electrode material, to flow into the freshly drilled retention features, which are located within the blind bore. Upon solidifying, this center electrode material forms a mechanical interlock with the firing tip, providing a secure attachment of the tip without any melting or welding of the noble metal tip itself. After this step has been performed, the center electrode assembly could be angularly indexed such that the pair of laser heads can melt additional portions of the center electrode. In both techniques, the molten material (whether it be a combination of center electrode and noble metal materials, or just center electrode material) flows into the retention features and solidifies to form a hardened fusion layer, such as exemplified fusion layer 102.

Fusion layer 102 is comprised of the material (be it center electrode material, noble metal material or a combination thereof) that was melted during the joining process, and securely attaches the two components together. The laser heads used during the joining process of step 76 can either by the same as those used during the laser drilling process of step 74, or they could be a separate set of laser heads altogether. Examples of laser joining techniques that could be used are explained in EP Patent No. 1 286 442, the entire contents of which are incorporated herein by reference.

Figure 5:
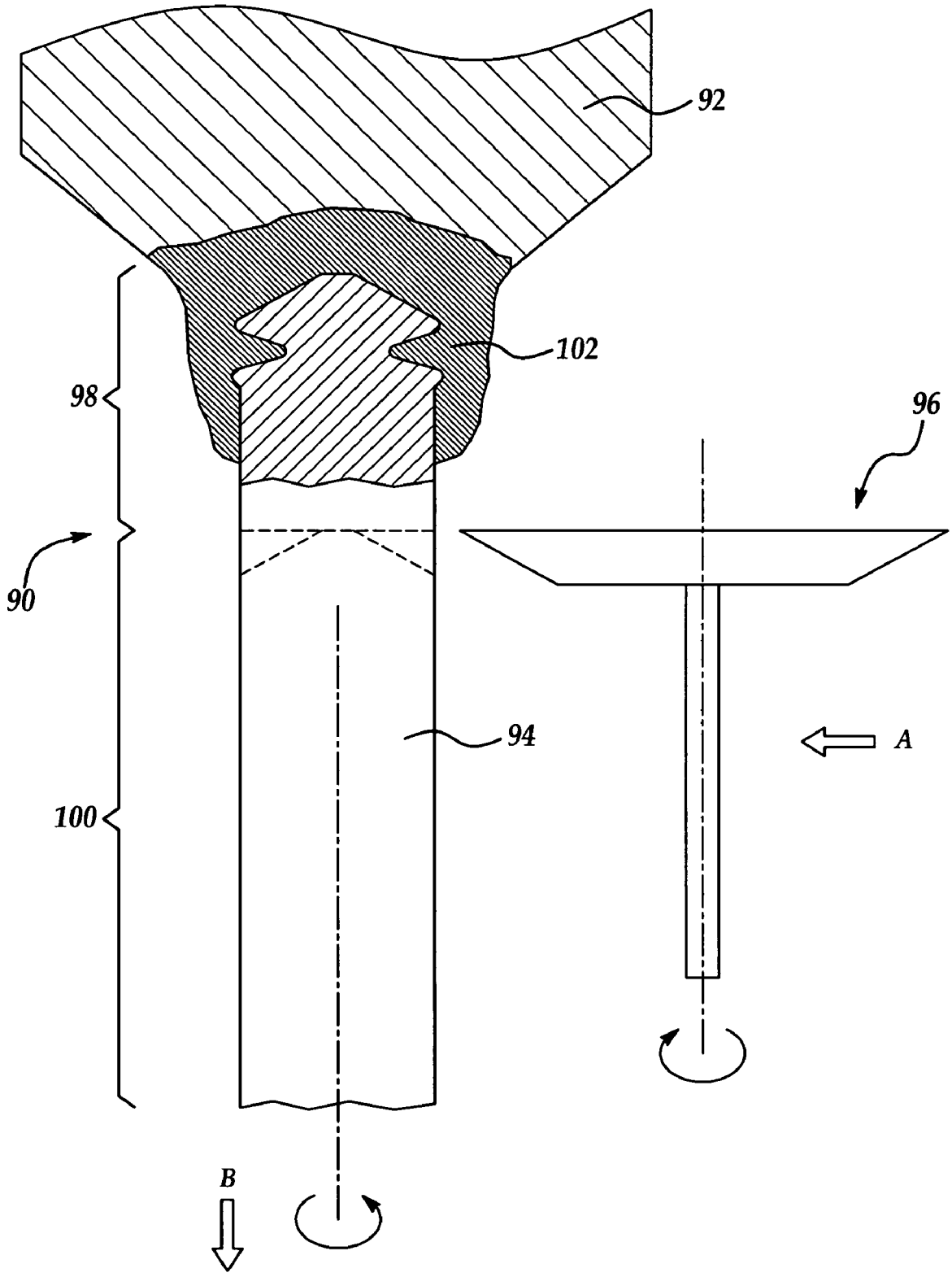
FIG. 5 demonstrates one of the steps of the flowchart of FIG. 3 in greater detail.

Once the noble metal wire and center electrode have been properly joined together, the wire is cut to a predetermined length, step 78. With reference to FIG. 5, there is shown an arrangement that could be used to carry out step 78. Bearing-mounted clamping components (not shown) carry a center electrode assembly 90 such that the entire assembly can rotate. Center electrode assembly 90 includes a center electrode component 92 attached to a noble metal wire 94, as step 78 occurs subsequent to joining step 76. Center electrode assembly 90 is rotated at high speeds, as is a rotating tapered cutting wheel 96. The center electrode assembly and cutting wheel each have axes that are parallel to one another. While rotating, the cutting wheel is radially advanced to cut the noble metal wire at a predetermined length. This radial advancement is demonstrated by solid arrow A, and the radial cut is shown in dotted lines. In order to assure a good break between that section of the noble metal wire that remains attached to the center electrode, section 98, and that section that is additional stock to be used with other center electrode components, section 100, a slight axial force B is exerted on the noble metal wire. Once cutting wheel 96 has abrasively cut through a significant portion of the radius of the wire, the tensile strength of the remaining uncut portion of the wire succumbs to the slight axial force B such that the wire separates. This separation leaves a flat-ended noble metal tip, section 98, attached to the center electrode, and a length of noble metal wire, section 100, having a tapered attachment end for subsequent attachment to a different center electrode component. To ensure that section 98 has a flat sparking surface, after separation, the cutting wheel 96 continues moving across the surface in direction A thereby removing any burrs or pips that might remain. Again, other methods exist for cutting the noble metal wire to a predetermined length, the process shown in FIG. 5 simply being one of them.

Returning to FIG. 4, at step 80 the newly manufactured center electrode assembly is removed and transferred to an area where it can be automatically inspected. The inspection can either be on-line or off-line and can use, for example, optical techniques to sort and detect for quality rejects. At this point, the process is capable of repeating itself.

The previous description of the noble metal tip has been largely confined to embodiments where it is attached to a center electrode component, however, the noble metal tip could just as easily be attached to a ground electrode component. In such an embodiment, a blind bore is formed on the side surface of the ground electrode in an area proximate the spark gap. A noble metal tip having an attachment end, a firing end and one or more retention features is then inserted into the blind bore in the ground electrode such that the firing end protrudes from the ground electrode side surface. Other features and manufacturing steps are similar to those already discusses, thus, a repeat explanation has been omitted. Alternatively, the noble metal tip may be attached to the free end surface of the ground electrode. The ground electrode being so positioned to form a radially disposed spark-gap configuration with the center electrode.

It will thus be apparent that there has been provided in accordance with the present invention a noble metal tip for a spark plug electrode and a method of manufacturing the same which achieve the aims and advantages specified herein. It will of course be understood that the foregoing description is of preferred exemplary embodiments of the invention and that the invention is not limited to the specific embodiments shown. For example, it is possible to add, delete or modify certain manufacturing steps from the overview represented in FIG. 4 and still produce a noble metal tip and/or center electrode assembly according to the present invention. Various changes and modifications will become apparent to those skilled in the art and all such variations and modifications are intended to come within the scope of the appended claims.

We claim:

1. A noble metal tip for use with a spark plug electrode, comprising:

a firing end having a sparking surface, an attachment end, and a retention feature at least partially surrounded by an outwardly protruding lip and extending generally radially into said noble metal tip from said protruding lip, said retention feature being located adjacent said attachment end.

2. The noble metal tip of claim 1, wherein said noble metal tip has a diameter.

3. The noble metal tip of claim 2, wherein said retention feature radially extends only partially through the diameter of said noble metal tip.

4. The noble metal tip of claim 3, wherein said retention feature comprises a hole extending inwardly into said noble metal tip.

5. The noble metal tip of claim 1, wherein said retention feature radially extends into said noble metal tip by a distance that is less than one half of the diameter of said noble metal tip.

6. The noble metal tip of claim 1, wherein said tip further comprises a plurality of said retention features, and wherein one or more of said features are located at a first axial position along said tip and one or more of said features are located at a second axial position along said tip, said first and second axial positions being spaced from one another.

7. The noble metal tip of claim 1, wherein said noble metal tip is comprised of an Ir-based material.

8. An electrode assembly including the noble metal tip of claim 1.

9. A spark plug including the electrode assembly of claim 8.

10. A noble metal tip for use with a spark plug electrode, comprising:

a firing end having a sparking surface, an attachment end, and a retention feature extending generally radially into said noble metal tip from an exposed surface of said noble metal tip, said retention feature being located adjacent said attachment end, wherein said retention feature radially extends only partially through a diameter of said noble metal tip, and wherein said retention feature is of a generally conical shape.

11. A noble metal tip for use with a spark plug electrode, comprising:

a firing end having a sparking surface, an attachment end, and a retention feature extending generally radially into said noble metal tip from an exposed surface of said noble metal tip, said retention feature being located adjacent said attachment end, wherein said noble metal tip further comprises a plurality of said retention features, and wherein one or more of said features are located at a first axial position along said tip and one or more of said features are located at a second axial position along said tip, said first and second axial positions being spaced from one another, and wherein first and second retention features are located at said first axial position and are circumferentially spaced from one another by approximately 180°, and third and fourth retention features are located at said second axial position and are circumferentially spaced from one another by approximately 180°.

12. The noble metal tip of claim 11, wherein said retention features comprise holes extending inwardly into said noble metal tip.

13. A center electrode assembly for use in a spark plug, comprising:

a center electrode component including a front end having a blind bore formed therein, a generally cylindrical noble metal tip secured within said blind bore, said tip including:

a firing end having a sparking surface, an attachment end located within said blind bore, and a preformed retention feature, and a fusion layer that extends into said preformed retention feature without mechanical deformation of said center electrode component front end, and locks said noble metal tip to said center electrode.

14. The center electrode assembly of claim 13, wherein said tip further comprises a plurality of said retention features, and wherein one or more of said features are located at a first axial position along said tip and one or more of said features are located at a second axial position along said tip, said first and second axial positions being spaced from one another.

15. The center electrode assembly of claim 13, wherein said sparking surface protrudes beyond the end of said center electrode front end by a distance between 0.1 mm-1.0 mm.

16. The center electrode assembly of claim 13, wherein said sparking surface has a diameter between 0.25 mm-1.0 mm.

17. The center electrode assembly of claim 13, wherein said noble metal tip is comprised of an Ir-based material.

18. The center electrode assembly of claim 13, wherein said center electrode component is comprised of a nickel-based material having a thermal conductivity of greater than 30 W/mK during normal spark plug operating temperatures.

19. A spark plug including the center electrode assembly of claim 13.

20. The center electrode assembly of claim 13, wherein said retention feature radially extends only partially through the diameter of said noble metal tip.

21. The center electrode assembly of claim 20, wherein said retention feature comprises a groove that extends around the entire circumference of said noble metal tip.

22. The center electrode assembly of claim 20, wherein said retention feature comprises a hole extending inwardly into said noble metal tip.

23. The center electrode assembly of claim 13, wherein said retention feature radially extends into said noble metal tip by a distance that is less than one half of the diameter of said noble metal tip.

24. A center electrode assembly for use in a spark plug, comprising:

a center electrode component including a front end having a blind bore formed therein, a generally cylindrical noble metal tip secured within said blind bore, said tip including:

a firing end having a sparking surface, an attachment end located within said blind bore, and a preformed retention feature, and a fusion layer that extends into said preformed retention feature and locks said noble metal tip to said center electrode, wherein said retention feature radially extends only partially through a diameter of said noble metal tip, and wherein said retention feature is of a generally conical shape.

25. A center electrode assembly for use in a spark plug, comprising:

a center electrode component including a front end having a blind bore formed therein, a generally cylindrical noble metal tip secured within said blind bore, said tip including:

a firing end having a sparking surface, an attachment end located within said blind bore, and a preformed retention feature, and a fusion layer that extends into said preformed retention feature and locks said noble metal tip to said center electrode, wherein said noble metal tip further comprises a plurality of said retention features, wherein first and second retention features are located at a first axial position and are circumferentially spaced from one another by approximately 180°, and third and fourth retention features are located at a second axial position and are circumferentially spaced from one another by approximately 180°.

26. An electrode assembly for a spark plug, comprising:

an electrode;

a noble metal tip having an attachment end and a firing end that includes a sparking surface, said attachment end being recessed into said electrode;

wherein said noble metal tip includes one or more recessed retention features extending inwardly into said tip from a peripheral surface of said tip at a location intermediate said attachment end and said firing end; and wherein said tip is locked to said electrode by material that: i) includes electrode material without any significant amount of noble metal material, ii) extends into said one or more recessed retention features, and iii) conforms with the shape of said one or more recessed retention features.

27. The electrode assembly of claim 26, wherein said electrode comprises a center electrode.

28. The electrode assembly of claim 26, wherein said one or more retention features comprises a plurality of holes including first and second holes angularly spaced from each other about said peripheral surface of said tip.

29. The electrode assembly of claim 28, wherein said first and second holes are located at a common axial position on said tip.

30. The electrode assembly of claim 28, wherein said first and second holes are axially spaced from each other.

31. The electrode assembly of claim 28, wherein said plurality of holes comprises four holes.

32. An electrode assembly for a spark plug, comprising:

a center electrode;

a noble metal tip having an attachment end and a firing end that includes a sparking surface, said attachment end being recessed into said center electrode;

wherein said noble metal tip includes one or more preformed retention features extending inwardly into said tip from a peripheral surface of said tip at a location intermediate said attachment end and said firing end; and wherein said tip is secured to said center electrode by a localized, laser-formed fusion layer that extends into said one or more preformed retention features.

33. The electrode assembly of claim 32, wherein said tip is welded to said center electrode by said localized laser formed fusion layer, whereby said localized laser formed fusion layer includes material from both said tip and said center electrode.

34. An electrode assembly for a spark plug, comprising:

a center electrode;

a noble metal tip having an attachment end and a firing end that includes a sparking surface, said attachment end being recessed into said center electrode;

wherein said noble metal tip includes one or more preformed retention features extending inwardly into said tip from a peripheral surface of said tip at a location intermediate said attachment end and said firing end; and wherein said tip is secured to said center electrode by a fusion layer that extends into said one or more preformed retention features, and wherein said fusion layer includes only material from said center electrode, whereby said tip is locked to said center electrode.

* * * * *